US012050062B2

(12) United States Patent
Berry et al.

(10) Patent No.: US 12,050,062 B2
(45) Date of Patent: Jul. 30, 2024

(54) STACKED COOLING ASSEMBLY FOR GAS TURBINE COMBUSTOR

(71) Applicant: General Electric Company, Schenectady, NY (US)

(72) Inventors: Jonathan Dwight Berry, Simpsonville, SC (US); Elizabeth Iola Paasche, Greenville, SC (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 17/494,880

(22) Filed: Oct. 6, 2021

(65) Prior Publication Data

US 2023/0104922 A1 Apr. 6, 2023

(51) Int. Cl.

| | |
|---|---|
| ***F23R 3/04*** | (2006.01) |
| ***F28D 1/03*** | (2006.01) |
| ***F28F 13/12*** | (2006.01) |
| *F23R 3/14* | (2006.01) |
| *F23R 3/28* | (2006.01) |
| *F28D 21/00* | (2006.01) |

(52) U.S. Cl.

CPC ..... *F28D 1/0308* (2013.01); *F28F 13/12* (2013.01); *F23R 3/14* (2013.01); *F23R 3/283* (2013.01); *F23R 3/286* (2013.01); *F28D 2021/0021* (2013.01); *F28D 2021/0026* (2013.01)

(58) Field of Classification Search

CPC .. F23R 3/283; F23R 3/286; F23R 3/14; F28F 13/12; F28D 2021/0021; F28D 2021/0026

See application file for complete search history.

(56) References Cited

U.S. PATENT DOCUMENTS

| | | | | |
|---|---|---|---|---|
| 3,881,701 | A * | 5/1975 | Schoenman | B01F 25/23 239/420 |
| 4,850,537 | A * | 7/1989 | Gourdine | B05B 7/10 239/406 |
| 5,456,596 | A * | 10/1995 | Gourdine | B05B 7/0884 431/9 |
| 6,254,334 | B1 | 7/2001 | LaFleur | |
| 7,717,164 | B2 | 5/2010 | Richter | |
| 9,010,122 | B2 | 4/2015 | Bangerter et al. | |
| 9,488,057 | B2 | 11/2016 | Jeng et al. | |
| 9,939,152 | B2 | 4/2018 | Hannemann et al. | |
| 9,939,154 | B2 | 4/2018 | Cunha | |
| 10,830,142 | B2 | 11/2020 | DiCintio et al. | |
| 2010/0263386 | A1 | 10/2010 | Edwards et al. | |
| 2011/0179795 | A1 * | 7/2011 | Johnson | F23R 3/28 60/725 |

(Continued)

FOREIGN PATENT DOCUMENTS

| | | | |
|---|---|---|---|
| CN | 203935832 U | * | 11/2014 |
| EP | 2685170 A1 | | 1/2014 |

*Primary Examiner* — Eric S Ruppert

(74) *Attorney, Agent, or Firm* — Dority & Manning, P.A.

(57) ABSTRACT

Stacked cooling assemblies and combustor bead ends are provided. A stacked cooling assembly includes an inlet plate defining an inlet to a coolant circuit, an outlet plate defining an outlet of the coolant circuit, and an intermediate plate disposed between the inlet plate and die outlet plate. The intermediate plate defines an intermediate cavity. A downstream surface of the inlet plate, an upstream surface of the outlet plate, and the intermediate cavity collectively define a connecting channel that fluidly couples the inlet to the outlet.

19 Claims, 10 Drawing Sheets

(56) References Cited

U.S. PATENT DOCUMENTS

| | | | |
|---|---|---|---|
| 2015/0375322 | A1 | 12/2015 | Salm et al. |
| 2016/0230993 | A1 | 8/2016 | Dai et al. |
| 2016/0281988 | A1 | 9/2016 | Tu, Jr. et al. |
| 2017/0356652 | A1 | 12/2017 | Singh et al. |
| 2020/0300165 | A1 | 9/2020 | Berry et al. |

* cited by examiner

STACKED COOLING ASSEMBLY FOR GAS TURBINE COMBUSTOR

FIELD

The present disclosure relates generally to stacked cooling assemblies for turbomachine combustors. In one embodiment, the present disclosure relates to a stacked combustor cap assembly for a gas turbine combustor.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering tire gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

In a typical can-annular combustion system, each of the combustors includes surfaces that are exposed to high temperature combustion gases, including the liner through which the combustion gases travel to the turbine section and the combustion cap which holds the fuel nozzles and defines the upstream boundary of the combustion chamber. The combustion cap, which includes one or more plates disposed on an aft end of the fuel nozzles, separates and protects the fuel nozzles from the high temperature combustion gases within the combustion chamber. However, issues exist with the use of many known cap plates. For example, because the cap plate is often in close proximity to the combustion gases, it may have a relatively low hardware life and may experience wear much quicker than other components of the combustor. As the combustion gases travel through the liner, certain areas may be more exposed than others to high temperature combustion gases ("hot spots"). Accordingly, an improved combustion surface having increased hardware life and decreased manufacturing costs would be useful and desired in the art.

BRIEF DESCRIPTION

Aspects and advantages of the stacked cooling assemblies and combustor head ends in accordance with the present disclosure w ill be set forth in part in the following description, or may be obvious from the description, or may be learned through practice of the technology.

In accordance with one embodiment, a slacked cooling assembly is provided. The stacked cooling assembly includes an inlet plate defining an inlet to a coolant circuit, an outlet plate defining an outlet of the coolant circuit, and an intermediate plate disposed between the inlet plate and the outlet plate. The intermediate plate defines an intermediate cavity. A downstream surface of the inlet plate, an upstream surface of the outlet plate, and the intermediate cavity collectively define a connecting channel that fluidly couples the inlet to the outlet.

In accordance with another embodiment, a combustor head end is provided. The combustor head end includes a stacked cooling assembly that defines a cap of the combustor head end. A fuel nozzle extends through the stacked cooling assembly. The stacked cooling assembly includes an inlet plate defining an inlet to a coolant circuit, an outlet plate defining an outlet of the coolant circuit, and an intermediate plate disposed between the inlet plate and the outlet plate. The intermediate plate defines an intermediate cavity. A downstream surface of the inlet plate, an upstream surface of the outlet plate, and the intermediate cavity collectively define a connecting channel that fluidly couples the inlet to the outlet.

These and other features, aspects, and advantages of the present slacked cooling assemblies and combustor head ends will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present slacked cooling assemblies and combustor head ends, including the best mode of making and using the present systems and methods, directed to one of ordinary skill in the art, is set forth in the specification, which makes reference to the appended figures, in which.

DETAILED DESCRIPTION

Figure 1:
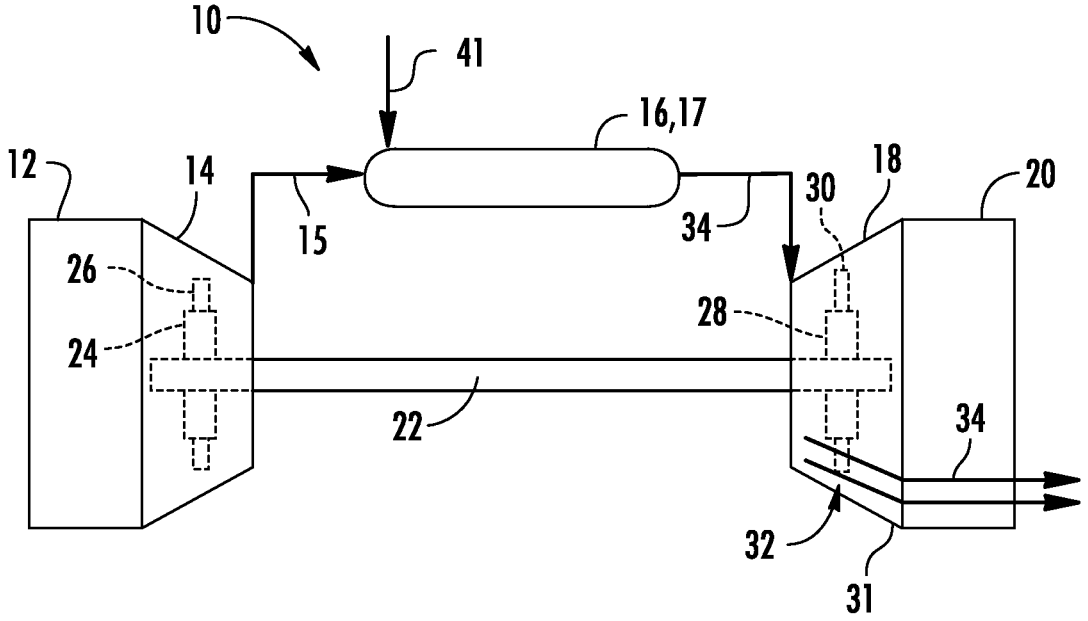
FIG. 1 is a schematic illustration of a turbomachine in accordance with embodiments of the present disclosure.

Reference now will be made in detail to embodiments of the present stacked cooling assemblies and combustor head ends, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

The term "fluid" may be a gas or a liquid. The term "fluid communication" means that a fluid is capable of making the connection between the areas specified.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular components.

Terms of approximation, such as "about," "approximately." "generally." and "substantially," are not to be limited to the precise value specified. In at least some instances, the approximating language may correspond to the precision of an instrument for measuring the value or the precision of the methods or machines for constructing or manufacturing the components and or systems. For example, the approximating language may refer to being within a 1, 2, 4, 5, 10, 15 or 20 percent margin in either individual values, range(s) of values, and or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. The terms "directly coupled to," "directly fixed to," "directly attached to," and the like indicate a direct connection between two components with no intervening components. As used herein, the terms "comprises," "comprising," "includes," "including," "has," "having" or any other variation thereof, are intended to cover a non-exclusive inclusion. For example, a process, method, article, or apparatus that composes a list of features is not necessarily limited only to those features but may include other features not expressly listed or inherent to such process, methods, article, or apparatus. Further, unless expressly stated to the contrary, "or" refers to an inclusive- or and not to an exclusive- or. For example, a condition A or B is satisfied by any one of the following. A is true (or present); and B is false (or not present); A is false (or not present), and B is true (or present); and both A and B are true (or present).

Here and throughout the specification and claims, range limitations are combined and interchanged, such ranges being identified and including all the sub-ranges contained therein unless context or language indicates otherwise. For example, all ranges disclosed herein are inclusive of the endpoints, and the endpoints are independently combinable with each other.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to a land-based and/or industrial gas turbine unless otherwise specified in the claims. For example, the stacked cooling assembly as described herein may be used in any type of turbomachine, including but not limited to a steam turbine, an aircraft gas turbine, or a marine gas turbine.

As shown, gas turbine 10 generally includes an inlet section 12, a compressor section 14 disposed downstream of the inlet section 12, a plurality of combustors (not shown) within a combustor section 16 disposed downstream of the compressor section 14, a turbine section 18 disposed downstream of the combustor section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds the portion of the shaft 22 and the rotor blades 30, thereby at least partially defining a hot gas path 32 through the turbine section 18.

During operation, a working fluid such as air flows through the inlet section 12 and into the compressor section 14 where the air is progressively compressed through stages of rotor blades 26 and stationary vanes (not shown), thus providing pressurized air 15 to the combustors 17 of the combustor section 16. The pressurized air 15 is mixed with fuel 41 and burned within each combustor 17 to produce combustion gases 34. The combustion gases 34 flow through the hot gas path 32 from the combustor section 16 into the turbine section 18, wherein energy (kinetic and or thermal) is transferred from the combustion gases 34 to the rotor blades 30 through multiple stages of rotor blades 30 and stationary vanes (not shown), causing the shaft 22 to rotate. The mechanical rotational energy may then be used to power the compressor section 14 and/or to generate electricity. The combustion gases 34 exiting the turbine section 18 may then be exhausted from the gas turbine 10 via the exhaust section 20.

Figure 2:
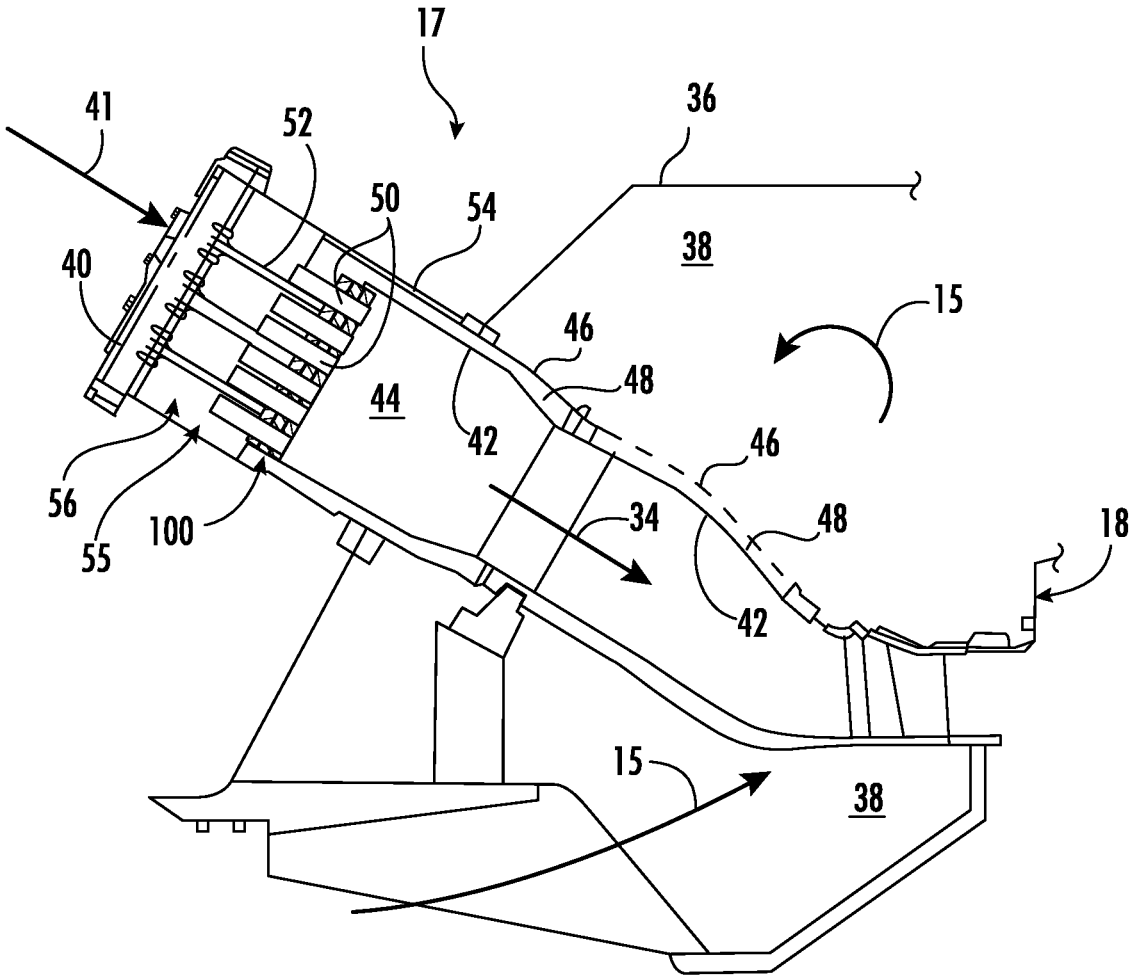
FIG. 2 illustrates a cross-sectional view of a combustor in accordance with embodiments of the present disclosure.

As show n in FIG. 2, the combustor 17 may be at least partially surrounded by an outer casing 36 such as a compressor discharge casing. The outer casing 36 may at least partially define a high-pressure plenum 38 that at least partially surrounds various components of the combustor 17. The high-pressure plenum 38 may be in fluid communication with the compressor section 14 (FIG. 1) so as to receive the compressed air 15 therefrom. An end cover 40 may be coupled to the outer casing 36 or to a forward casing 54. One or more combustion liner's or ducts 42 may at least partially define a combustion chamber or zone 44 for combusting the fuel-air mixture and/or may at least partially define a hot gas path through the combustor 17 for directing the combustion gases 34 towards an inlet to the turbine section 18.

In particular embodiments, the combustion liner 42 is at least partially circumferentially surrounded by an outer sleeve 46. The outer sleeve 46 may be formed as a single component or by multiple outer sleeve segments. The outer sleeve 46 is radially spaced from the combustion liner 42 so as to define a flow passage or annular flow passage 48 therebetween. The outer sleeve 46 may define a plurality of inlets or holes which provide for fluid communication from the high-pressure plenum 38 into the annular flow passage 48.

The forward easing 54 and die end cover 40 may define the head end air plenum 56. Compressed air 15 may flow from high pressure plenum 38 into the annular flow passage 48 at an aft end of the combustor 17, via openings defined in the outer sleeve 46. The compressed air 15 travels upstream from the all end of the combustor 17 to the head end air plenum 56, where the compressed air 15 reverses direction and enters at least one fuel nozzle 50.

A combustor head end 55 includes the head end air plenum 56 and the at least one fuel nozzle 50. The at least one fuel nozzle 50 may be positioned at the forward end of the combustor 17 (e.g., within the head end air plenum 56). Fuel 41 may be directed through fuel supply conduits 52, which extend through the end cover 40, the head end air plenum 56, and into the fuel nozzles 50. The fuel nozzles 50 convey the fuel and compressed air 15 into the combustion chamber 44, where combustion occurs, in some embodiments, live fuel and compressed air 15 are combined as a mixture prior to reaching the combustion chamber 44. The fuel nozzles 50 may be any type of fuel nozzle, such as bundled tube fuel nozzles (commonly referred to as "micromixers") or swirler nozzles (commonly referred to as "swozzles").

In exemplary embodiments, the aft, or downstream, ends of the fuel nozzles 50 extend at least partially through a stacked cooling assembly 100 that defines a cap of the combustor head end 55. For example, the stacked cooling assembly 100 may define the upstream end of the combustion chamber 44. In other words, the stacked cooling assembly 100 may define the aftmost boundary of the head end air plenum 56 and the forwardmost boundary of the combustion chamber 44, thereby separating the head end air plenum 56 from the combustion chamber 44.

Figure 3:
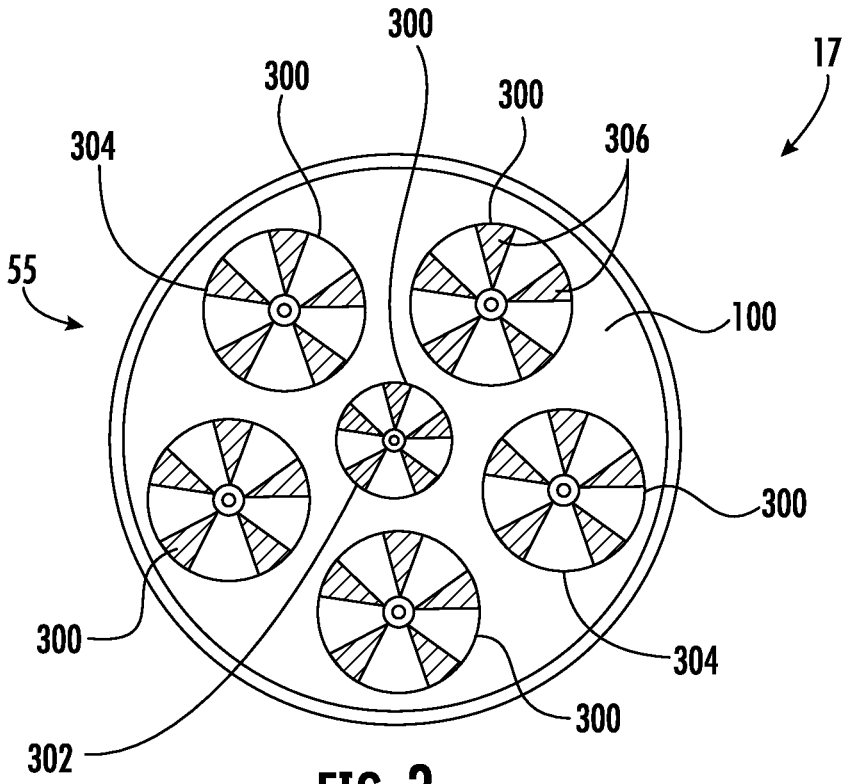
FIG. 3 illustrates a plan view of a combustor head end, in accordance with embodiments of the present disclosure, as viewed from an aft end of the combustor looking forward.
Figure 4:
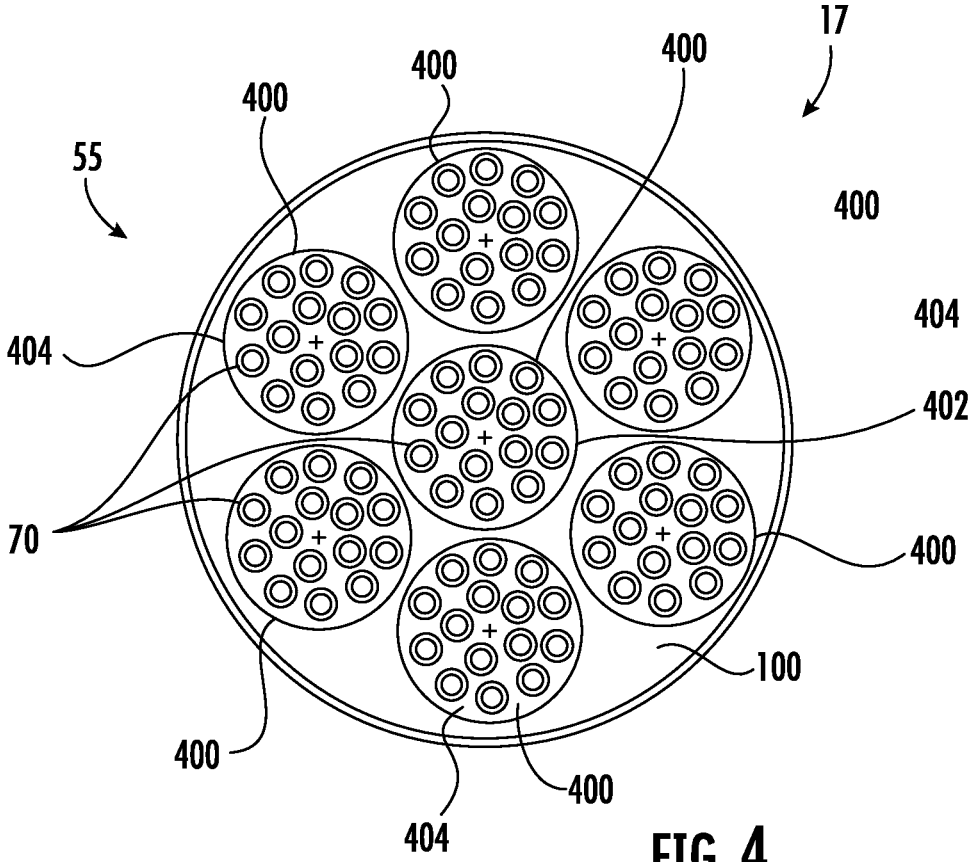
FIG. 4 illustrates a plan view of a combustor head end, in accordance with embodiments of the present disclosure, as viewed from an all end of the combustor looking forward.
Figure 5:
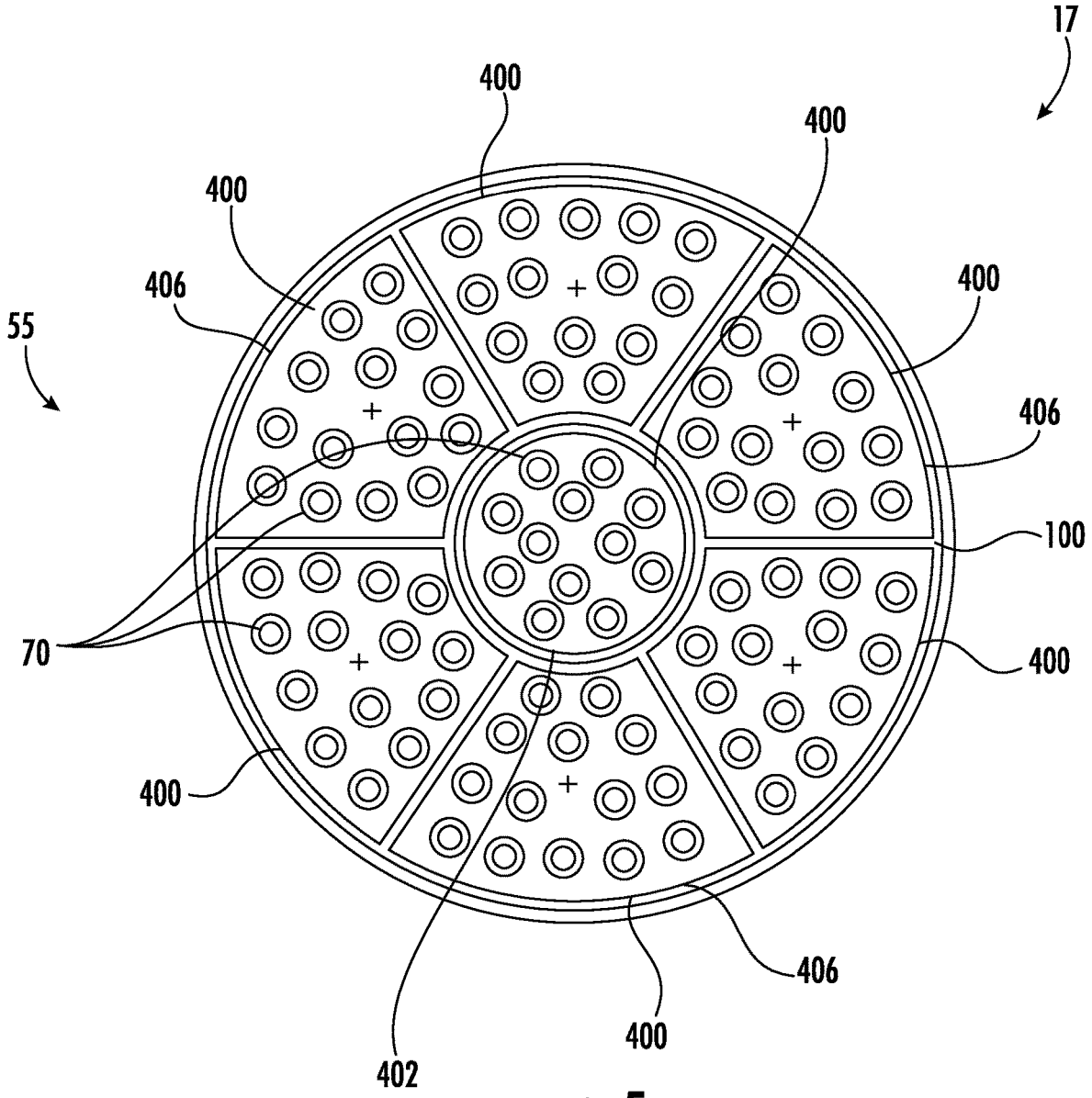
FIG. 5 illustrates a plan view of a combustor head end, in accordance with embodiments of the present disclosure, as viewed from an all end of the combustor looking forward.

FIGS. 3 through 5 each illustrate a plan view of exemplary combustor head ends 55 of the combustor 17, in accordance with various embodiments of the present disclosure. As shown in FIG. 3, the combustor 17 may include a plurality of swirler nozzles or swozzles 300. The plurality of swozzles may include a center swozzle 302 and a plurality of outer swozzles 304 annularly arranged about the center swozzle 302. As shown, each swozzle 300 may include a plurality of swirler vanes 306 that induce a swirling flow of air and fuel within the combustion chamber 44. Each of the swozzles may extend through a respective opening in the stacked cooling assembly 100 in order to introduce a mixture of fuel and air into the combustion chamber 44.

As shown in FIGS. 4 and 5, the combustor 17 may include a plurality of bundled tube fuel nozzles 400. Each bundled tube fuel nozzle 400 may include a plurality of premix tubes 70 within which fuel and air are mixed before introduction to the combustion chamber 44. In FIG. 4, each bundled tube fuel nozzle 400 extends through a respective opening in the stacked cooling assembly 100 to introduce a mixture of fuel and air into the combustion chamber 44. In FIG. 5, the stacked cooling assembly 100 includes a plurality of openings within which the premixed tubes 70 are disposed.

In the embodiments shown m both FIGS. 4 and 5, the plurality of bundled tube fuel nozzles 400 may include a center bundled tube fuel nozzle 402 that has a circular shape and a plurality of outer bundled tube fuel nozzles 404, 406 surrounding the center bundled tube fuel nozzle 402. For example, in the embodiment shown in FIG. 4, the plurality of bundled tube fuel nozzles 400 may include a plurality of circular outer bundled tube fuel nozzles 404 surrounding the center bundled tube fuel nozzle 402. In the embodiment shown in FIG. 5, the plurality of bundled tube fuel nozzles 400 may include a plurality of wedge shaped bundled tube fuel nozzles 406 surrounding the center bundled tube fuel nozzle 402.

Figure 6:
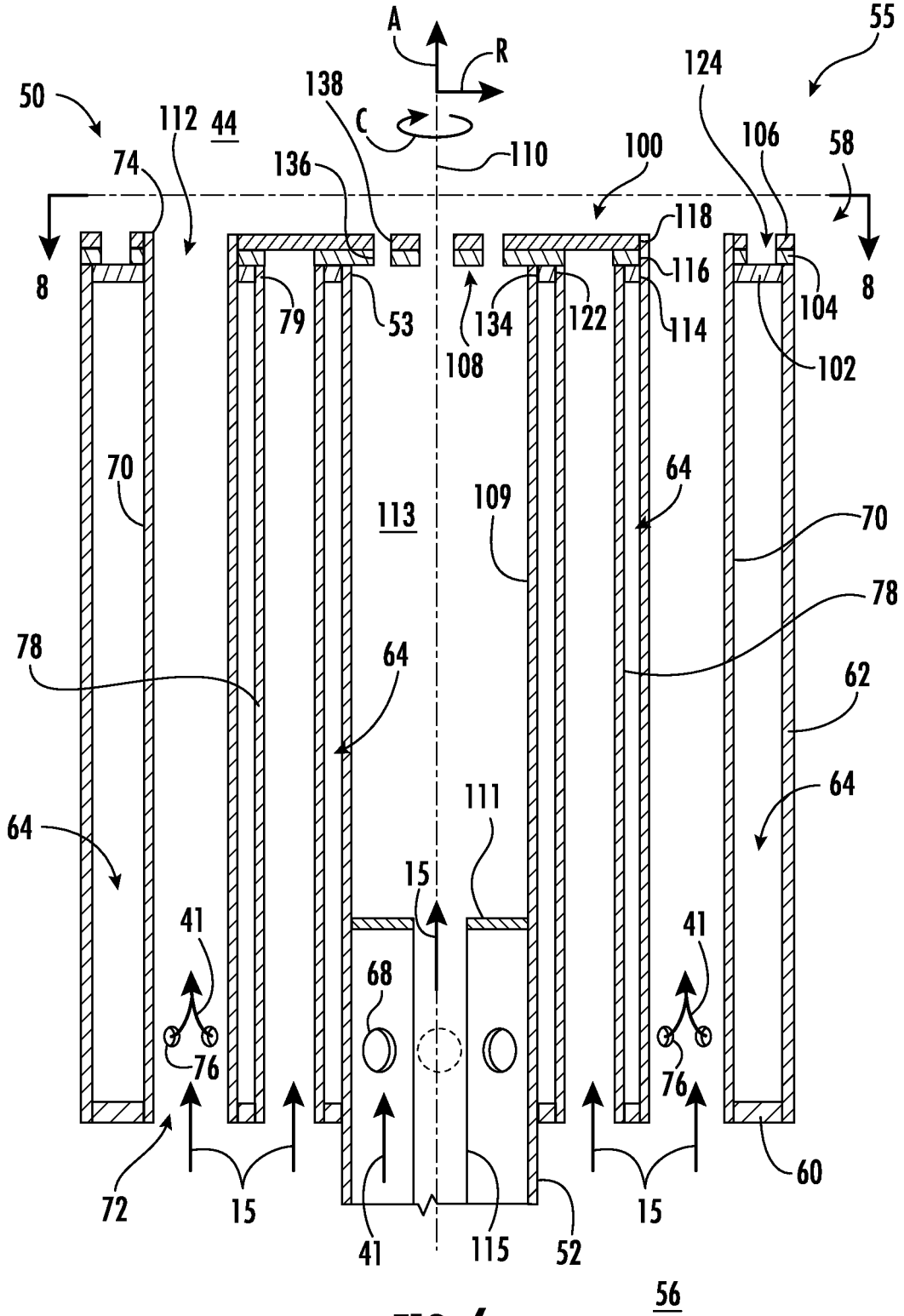
FIG. 6 illustrates a cross-sectional view of a fuel nozzle in accordance with embodiments of the present disclosure.

FIG. 6 provides a cross-sectional side view of a fuel nozzle 50, in accordance with embodiments of the present disclosure. The fuel nozzle 50 may define a cylindrical coordinate system having an axial direction A extending along the axial centerline 110, a radial direction R extending perpendicular to the axial centerline 110), and a circumferential direction C extending about the axial centerline 110. As shown in FIG. 6, the fuel nozzle 50 includes a fuel plenum body 58 having a forward or upstream wall 60. A stacked cooling assembly 100 is axially spaced from the forward wall 60. For example (with reference to FIG. 4), the forward wall 60 and the stacked cooling assembly 100 may be generally disc shaped, may be oriented generally parallel to each other, and may be axially spaced apart. An outer band or shroud 62 may extend axially between the forward wall 60 and the stacked cooling assembly 100. The outer band 62 may be generally shaped as a tube or a hollow cylinder (or cylindrical shell). A fuel plenum 64 may be defined within the fuel plenum body 58. In particular embodiments, the forward wall 60, the stacked cooling assembly 100 and the outer band 62 may collectively define the fuel plenum 64.

With reference to FIG. 3, the stacked cooling assembly 100 may function as a cap for a combustor head end 55, in which case individual fuel nozzles 300, 302, 304 may extend through openings 112 in the stacked cooling assembly 100. That is, each swirler fuel nozzle 300, 302, 304 may replace one of the premix tubes 70 shown schematically in FIG. 6. With reference to FIG. 5, each fuel nozzle 50, 400, 406 may have its own forward wall 60 and fuel plenum 64, while the downstream ends of the premix tubes 70 of the fuel nozzles 50, 400, 406 extend through a common (i.e., shared) stacked cooling assembly 100, which spans an entire width of the combustor head end 55.

As discussed below, the stacked cooling assembly 100 may include an inlet plate 102, an intermediate plate 104, and an outlet plate 106. Although the embodiments shown and discussed herein include a singular intermediate plate 104, it is within the scope and spirit of the present disclosure that multiple intermediate plates 104 may be utilized (e.g. disposed between the inlet plate 102 and the outlet plate 104). Each plate 102, 104, 106 may be generally disk shaped and in contact with at least one adjacent plate (e.g., stacked relative to each other). For example, the plates may be rigidly or fixedly coupled to on another (such as via welding, brazing, or other means of fixedly coupling). In other embodiments, the plates may be non-rigidly, non-fixedly, or otherwise removably coupled to one another (such as via a bolt and fastener or other means). In exemplary embodiments, as shown in FIG. 2, the inlet plate 102 may be positioned within the outer band 62 (e.g., at an all end of the outer band 62), such that the outer band 62 surrounds the inlet plate 102. In this way, an upstream surface of the inlet plate 102 may define an aftmost boundary of the fuel plenum 64 or, alternately, another plenum (such as an air plenum) defined within the fuel nozzle 50. The intermediate plate 104 may be disposed between, and in contact with, the inlet plate 102 and the outlet plate 106. The outlet plate 106 may at least partially define a forwardmost boundary of the combustion chamber 44.

Additionally, in the embodiment shown in FIG. 6, the inlet plate 102 may have a diameter generally equal to the interior diameter of the outer hand 62, in order to fit within an aft end of the outer hand 62. The intermediate plate 104 and the outlet plate 106 may have a diameter generally equal to (or greater than) the outer diameter of the outer band 62, in order to prevent ingestion of combustion gases. The slacked cooling assembly 100 may be unique to each fuel nozzle 50 or may be common among all the fuel nozzles 50 (e.g., such as the stacked cooling assembly 100 shown in FIG. 2).

In many embodiments, the fuel supply conduit 52 may extend through the forward wall 60 and the fuel plenum 64 to a separating wall 111. The separating wall 111 may prevent any fuel 41 from entering a resonator 109. The resonator 109 may extend from the separating wall 111 to a resonator circuit 108. The resonator 109 may define a resonator volume 113 for dampening acoustic vibrations of the combustor 17. In various embodiments, an inner tube 115 may extend through the fuel conduit 52 (fluidly isolated therefrom), and through the separating wall 111, to the resonator 109. In this way, the inner tube 115 may provide compressed air 15 to the resonator volume 113 to prevent ingestion of combustion gases 34 into the resonator volume 113. The resonator volume 113 may be fluidly isolated from the fuel circuit 52, such that no fuel 41 enters the resonator volume 113.

The fuel supply conduit 52 may be in fluid communication with the fuel plenum 64 via one or more fuel ports 68 defined in die fuel supply conduit 52. For example, the fuel ports 68 may be disposed in the fuel plenum 64 proximate the forward wall 60 of the fuel plenum body 58.

In many embodiments, one or more premix tubes 70 may extend (e.g., generally axially) through the fuel plenum body 58. For example, the one or more premix tubes 70 may extend through the forward wall 60, the fuel plenum 64, and the stacked cooling assembly 100. The premix tubes 70 are fixedly connected to and/or form a seal against the forward wall 60 and/or the stacked cooling assembly 100. For example, the premix tubes 70 may be welded, brazed or otherwise connected to one or more of the forward wall 60 and/or the stacked cooling assembly 100. Each premix tube 70 may be in fluid communication with the head end air plenum 50, the fuel plenum 64, and the combustion chamber 44. Each premix tube 70 includes an inlet 72 defined at an upstream end of each respective tube 106 and an outlet 74 defined at a downstream end of each respective tube 70. Compressed air 15 from the head end air plenum 56 may enter each of the premix tubes 70 at the inlet 72 and may be mixed with fuel 41 from the fuel plenum 64 before being expelled into the combustion chamber 44 at the outlet 74. In particular embodiments, the one or more premix tubes 70 are each in fluid communication with the fuel plenum 64 via one or more fuel ports 76 defined within the respective premix tube(s) 70.

In exemplary embodiments, a coolant tube 78 may extend to the stacked cooling assembly 100. For example, the coolant tube 78 may extend (generally axially) through the fuel plenum body 58. For example, one or more coolant tubes 78 may extend through tire forward wall 60, the fuel plenum 64, to the stacked cooling assembly 100 (e.g., partially through the stacked cooling assembly 100). Particularly, the coolant tubes 78 may convey compressed air 15 from the head end air plenum 56 to a coolant circuit 120 defined in the stacked cooling assembly 100. In this way, the coolant tubes 78 may be fluidly isolated from the fuel plenum 64 and the fuel supply conduit 52, such that only compressed air 15 is supplied to the coolant circuit 120.

Each of live coolant tubes 78 may extend only partially axially through the stacked cooling assembly 100. For example, a downstream end 79 of each coolant tube may extend through an inlet 122 of the coolant circuit 120 defined in the inlet plate 102. In this way, each of the coolant tubes 78 may extend axially through only the inlet plate 102 of the stacked cooling assembly 100, and each of the coolant tubes 78 may terminate axially at the intermediate plate 104. The coolant tubes 78 may be fixedly connected to and/or form a seal against the forward wall 60 and/or the stacked cooling assembly 100. For example, coolant tubes 78 may be welded, brazed or otherwise connected to one or more of the forward wall 60 and or the stacked cooling assembly 100. As shown in FIG. 6, the coolant tubes 78 may be disposed radially between the fuel supply conduit 52 and the premix tubes 70.

Figure 7:
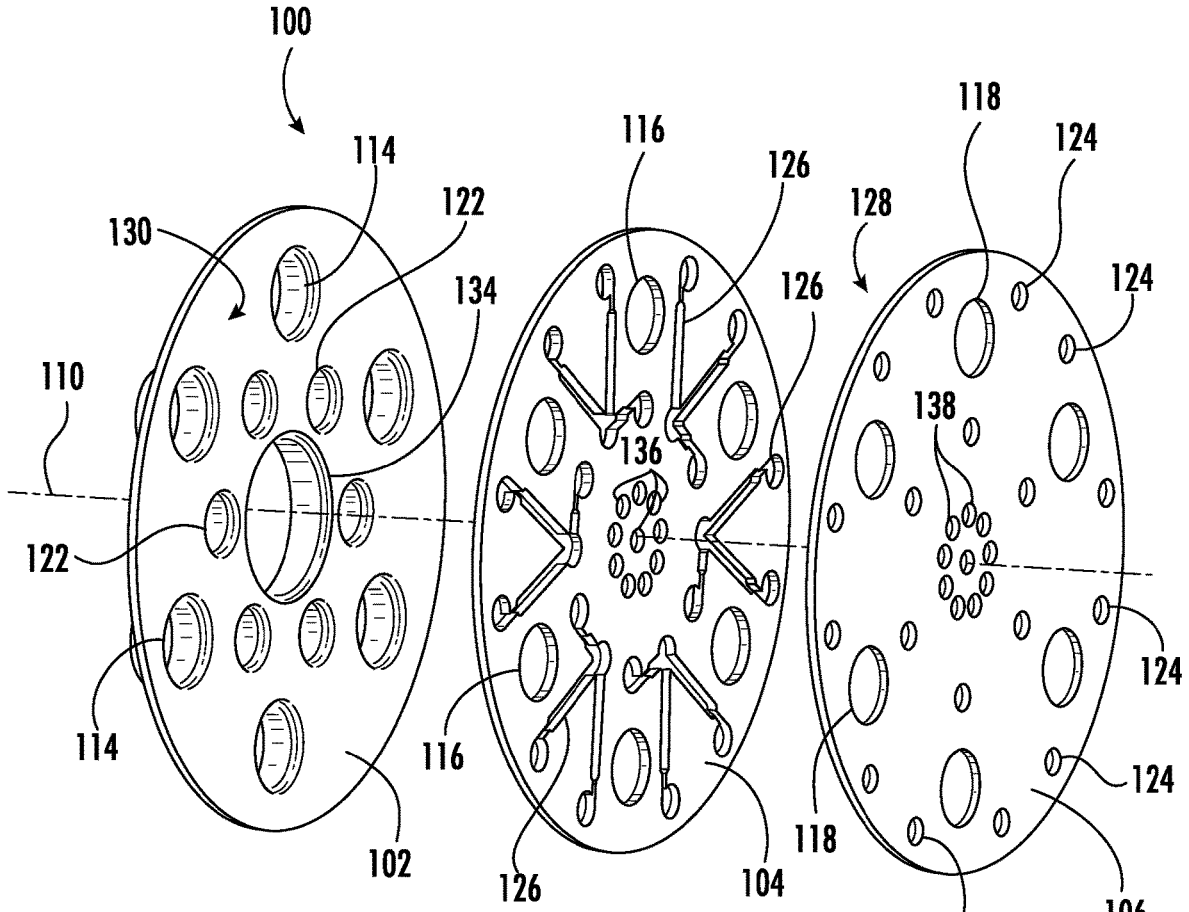
FIG. 7 illustrates an exploded view of a stacked cooling assembly in accordance with embodiments of the present disclosure.
Figure 8:
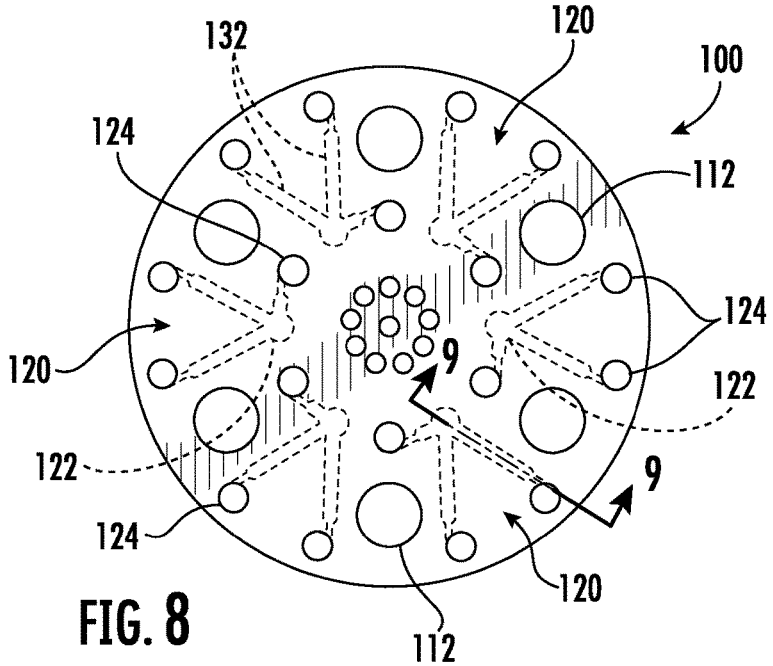
FIG. 8 illustrates a plan view of the stacked cooling assembly shown in FIG. 6 from along the line X-X in accordance with embodiments of the present disclosure.

FIG. 7 illustrates an exploded view of the stacked cooling assembly 100, and FIG. 8 illustrates a plan view of the stacked cording assembly 100 from along the line 8-8 shown in FIG. 6, in accordance with embodiments of the present disclosure. In exemplary embodiments, the plates 102, 104, 106 of the stacked cooling assembly 100 may each define one or more holes, voids, cavities, and/or crevices, such that when the plates 102, 104, 106 are stacked together, the plates 102, 104, 106 collectively define one or more circuits capable of conveying fluid (e.g., cooling air). Such a construction may provide many operational advantages, such as increased component cooling and/or fuel distribution, lower manufacturing costs, and ease of assembly. Additionally, the stacked plate construction of the stacked cooling, assembly 100 may advantageously lower manufacturing costs when compared to prior designs. For example, the various cavities defined in each of the plates 102, 104, 106, may be stamped onto the plates, which may advantageously reduce production cost and production time.

In particular embodiments, the stacked cooling assembly 100 may define a resonator circuit 108 (FIG. 6). Particularly, the resonator circuit 108 may be defined collectively by the inlet plate 102, the intermediate plate 104, and the outlet plate 106. The resonator circuit 108 may extend coaxially along an axial centerline 110 (which may be a common axial centerline to both the fuel nozzle 50 and the stacked cooling assembly 100). The resonator circuit 108 may be defined collectively by openings that extend axially through each of the plates 102, 104, 106. For example, as shown in FIGS. 6 and 7 collectively, the inlet plate 102 may define an inlet opening 134 of the resonator circuit 108, the outlet plate 106 may define a plurality of outlet openings 138, and the intermediate plate 104 may define a plurality of intermediate openings 136 fluidly coupling the inlet opening 134 to the plurality of outlet openings 138. The inlet opening 134 may be a singular opening (e.g., instead of a plurality of openings), such that the downstream end 53 of the resonator 109 may extend through the inlet opening 134(FIG. 6). In many embodiments, each of the outlet openings 138 in the plurality of outlet openings 138 may align with a respective intermediate opening 136 of the plurality of intermediate openings 136.

Additionally, the stacked cooling assembly 100 may define a plurality of outer passages 112 (FIG. 8) circumferentially spaced apart from one another. The plurality of outer passages 112 may be defined collectively by the plates 102, 104, 106 (e.g., collectively by openings that extend axially through each of the plates 102, 104, 106). For example, each outer passage 112 may extend axially through the inlet plate 102, the intermediate plate 104, and the outlet plate 106. Particularly, each outer passage 112 may be collectively defined by outer apertures 114, 116, 118 defined in the inlet plate 102, the intermediate plate 104, and the outlet plate 106, respectively. The apertures 114, 116, 118 may generally align with one another such that each outer passage 112 is shaped generally as a cylinder. As shown in FIG. 6, in many implementations, a downstream end of a premix tube 70 may extend through the outer passage (e.g., each of the apertures 114, 116, and 118). Although only six outer passages 112 are shown, the slacked cooling assembly 100 may include any number of outer passages 112 in any arrangement. Particularly, the stacked cooling assembly 100 may include a corresponding number and arrangement of outer cooling passages 112 as the number of premix tubes 70 (which may be different between embodiments), in order for each premix tube 70 to extend through the stacked coding assembly 100.

As shown collectively in FIGS. 6 through 8, in exemplary embodiments, the stacked cooling assembly 100 may further define a coolant circuit 120. Particularly, the stacked cooling assembly 100 may define a plurality of coolant circuits 120 circumferentially spaced apart front one another. Each coolant circuit 120 may be defined collectively by cavities that extend axially through each of the plates 102, 104, 106. For example, each coolant circuit 120 may include an inlet 122 defined in, and extending axially through, the inlet plate 102. The coolant circuit 120 may also include an outlet 124 defined in, and extending axially through, the outlet plate 106, Particularly, as shown in FIG. 8, each coolant circuit 120 may include a singular inlet 122 and a plurality of outlets 124. However, in other embodiments (not shown), each coolant circuit 120 may include multiple inlets 122 and a singular outlet 124, or any number of inlets 122 and outlets 124. Each outlet 124 of each coolant circuit 120 may be fluidly coupled to the respective inlet 122 via a connecting channel 152. In many embodiments, the outlet 124 is one of a plurality of outlets 124 each fluidly connected to the inlet 122 via a respective connecting channel 132. For example, the inlet 122 and the outlet(s) 124 may be spaced apart from one another in one or more directions (such as in at least two directions). Specifically, the inlet 122 and the outlet(s) 124 may be radially and/or circumferentially spaced apart from one another, such that the inlet 122 and the outlet 124 do not extend along a common axial axis. The inlet 122 and the outlet 124 may be shaped generally as axially oriented cylinders. The intermediate plate 104 may define an intermediate cavity 126 extending through the intermediate plate 104 that at least partially defines the connecting channels 132.

In many embodiments, the coolant circuit 120 may disposed radially outwardly of the resonator 108. In particular, the coolant circuits 120 may be disposed circumferentially between neighboring outer passages 112 of the plurality of outer passages 112.

Figure 9:
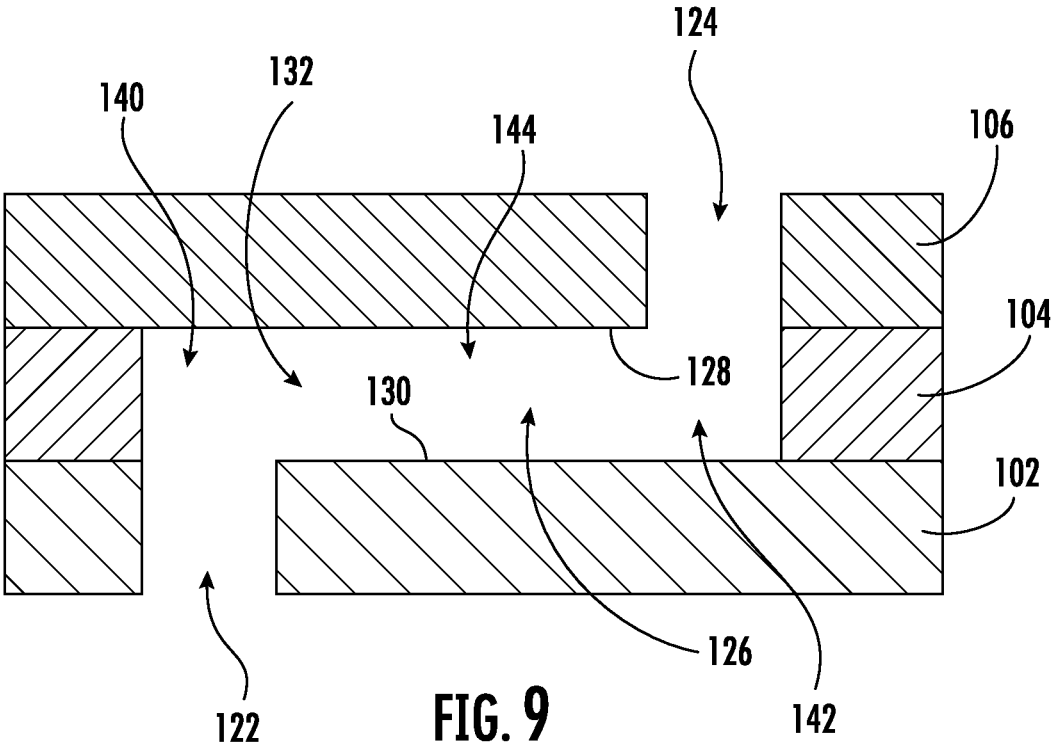
FIG. 9 illustrates a cross-sectional view of the stacked cooling assembly from along the line 9-9 shown in FIG. 8 in accordance with embodiments of the present disclosure.

FIG. 9 illustrates a cross-sectional view of a portion of a single cooling circuit 120 of the stacked cooling assembly 100 from along the line 9-9 shown in FIG. 8, in accordance with embodiments of the present disclosure. The intermediate cavity 126 may at least partially fluidly couple the inlet 122 to the outlet 124. In exemplary embodiments, as shown, an upstream surface 128 of the outlet plate 106, a downstream surface 130 of the inlet plate 102, and the intermediate cavity 126 collectively define the connecting channel 132 that fluidly couples the inlet 122 to the outlet 124.

In many embodiments, as shown in FIG. 9, the intermediate cavity 126 may include an inlet portion 140, an outlet portion 142, and a passage portion 144 extending between the inlet portion 140 and the outlet portion 142. For example, the inlet portion 140 may fluidly couple to and align with the inlet 122 of the coolant circuit 120. Similarly, the outlet portion 142 may fluidly couple to and align with the outlet 124 of coolant circuit 120. The passage portion 144 may extend between the inlet portion 140 and the outlet portion 142. As shown in FIG. 9, the downstream surface 130 of the inlet plate 102, the upstream surface 128 of the outlet plate 106, and the passage portion 144 of the intermediate cavity 126 may collectively define the connecting channel 132.

Figure 10:
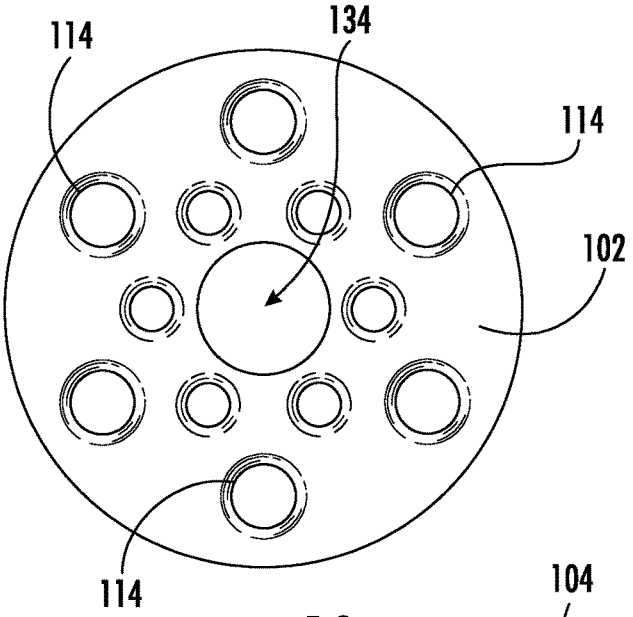
FIG. 10 illustrates a planar view of an inlet plate of the stacked cooling assembly of FIG. 6, in accordance with embodiments of the present disclosure.
Figure 11:
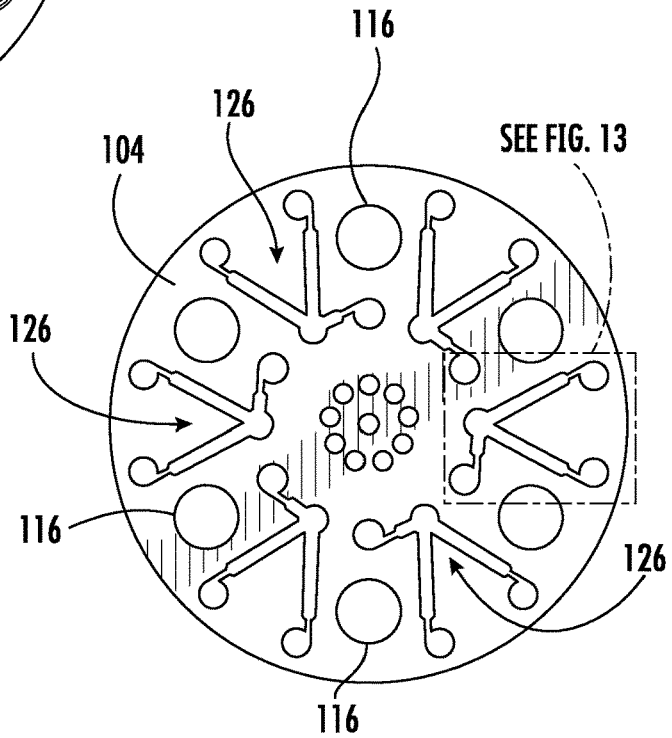
FIG. 11 illustrates a planar view of an intermediate plate of the stacked cooling assembly of FIG. 6, in accordance with embodiments of the present disclosure.
Figure 12:
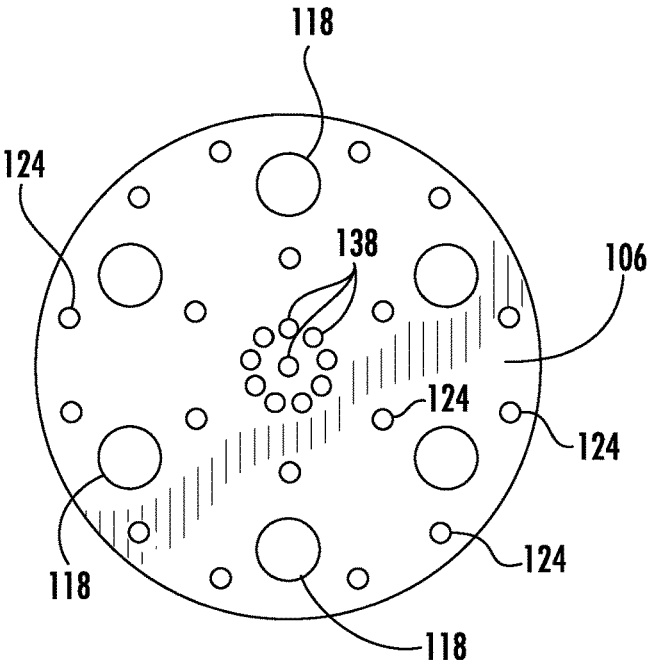
FIG. 12 illustrates a planar view of an outlet plate of the stacked cooling assembly of FIG. 6, in accordance with embodiments of the present disclosure.
Figure 13:
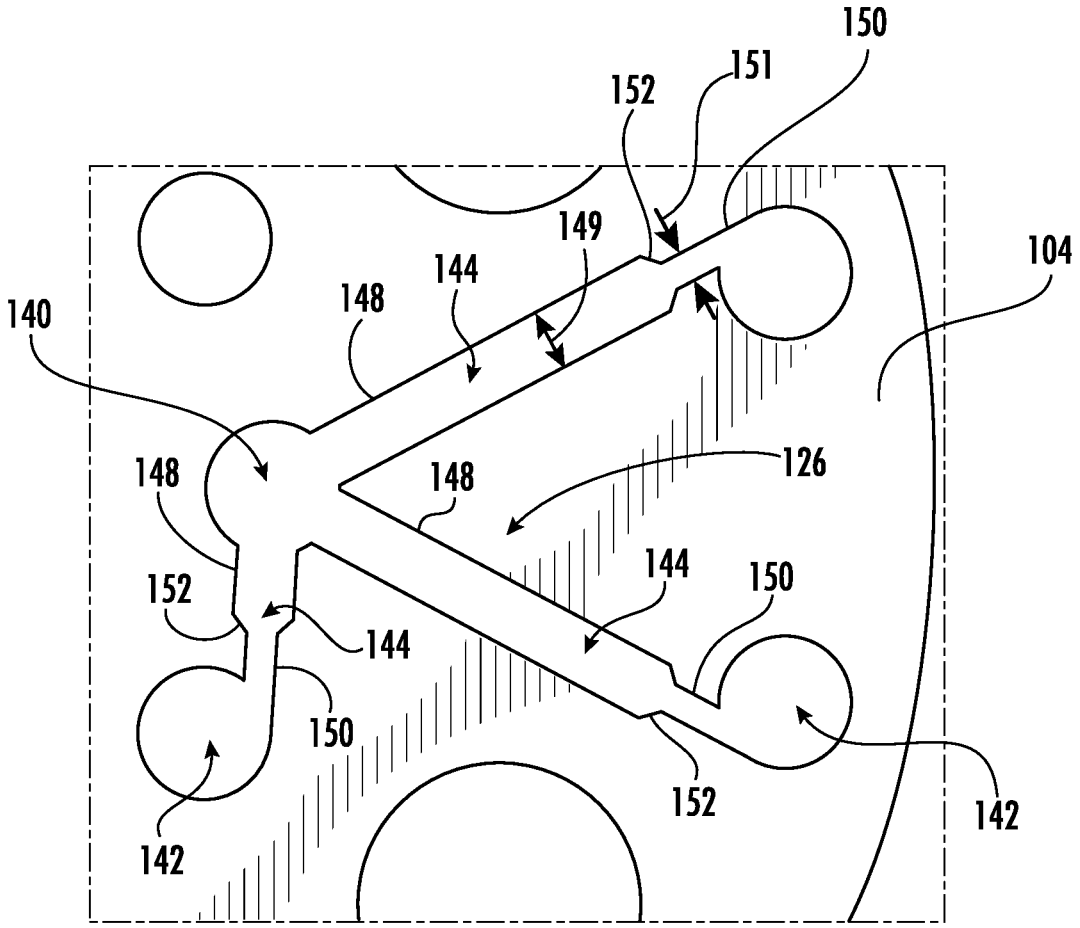
FIG. 13 illustrates an enlarged view of the outlined detail of the intermediate plate shown in FIG. 11, in accordance with embodiments of the present disclosure.

FIG. 10 illustrates a planar view of the inlet plate 102, FIG. 11 illustrates a planar view of the intermediate plate 104, and FIG. 12 illustrates a planar view of the outlet plate 106, in accordance with embodiments of the present disclosure. As shown, each of the plates 102, 104, 106 may be generally circularly shaped. Additionally, each of the plates 102, 104, 106 may have a substantially equal diameter (e.g., within +/−5%). The plates 102, 104, 106 may have substantially flat or planar upstream and downstream surfaces (FIG. 9), such that they may sealingly contact each other when stacked together, thereby preventing fluids front leaking between the plates 102, 104, 106 during operation, FIG. 13 illustrates an enlarged view of the outlined detail of the intermediate plate 104 shown in FIG. 11, in accordance with embodiments of the present disclosure. As shown and discussed above, the intermediate cavity 126 of the intermediate plate 104 may include an inlet portion 140 and one or more passage portions 144 extending from the inlet portion 140 to a respective outlet portion 142. For example, in the embodiments shown and described herein, each intermediate cavity 126 may include three passage portions 144 and three outlet portions 142. However, in other embodiments, the intermediate cavity 126 may include any number of passage portions 144 and corresponding outlet portions 142 (such as 1, 2, 3, 4, 5, 6, or up to 10).

In many embodiments, as shown in FIG. 13, each passage portion 144 may include a first segment 148 having a first width 149, a second segment 150 having a second width 151, and a tapering segment 152 between the first segment 148 and the second segment 150. The first segment 148 extends directly from the inlet portion 140 and the second segment 150 extends directly into the outlet portion 142. The second width 151 may be smaller than the first width 149, and the tapering segment 152 may taper in width from the first width 149 to the second width 151 (i.e., narrowing towards the outlet portion 142). The tapering segment 152 may be closer to the outlet portion 142 than the inlet portion 140, in order to accelerate the flow of air as the How of air is conveyed into the outlet portion 142.

The inlet portion 140 and the outlet portion 142 of the intermediate cavity 126 may be generally circularly shaped. The first segment 150 may extend generally non-tangentially from the inlet portion 142. The second segment 150 may connect directly to, and be oriented generally tangentially to, the outlet portion 142. For example, the passage portion 144 may be tangentially connected to the outlet portion 142 to induce a swirling flow of compressed air at the outlet portion 142. In this way, the second segment 150 may advantageously induce a swirling flow of compressed air exiting the outlet portion 142. For example, an axial centerline of the passage portion 144 (e.g., one or both of the first segment and the second segment 148, 150) does not extend through a center point of the outlet portion 142.

Figure 14:
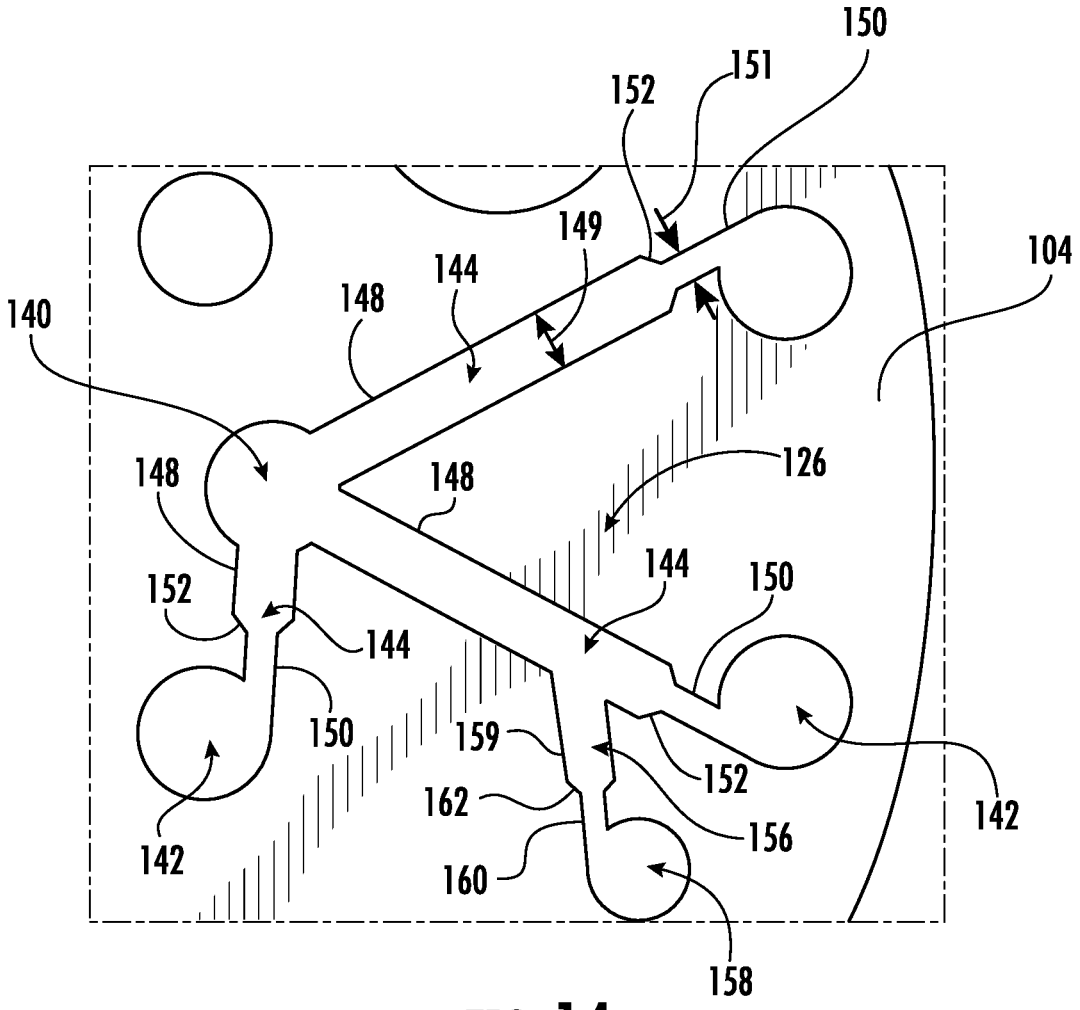
FIG. 14 illustrates an enlarged view of an alternate intermediate plate, in accordance with embodiments of the present disclosure.

FIG. 14 illustrates an alternative embodiment of the intermediate cavity 126 defined by the intermediate plate 104. As shown, a branch portion 156 may extend from the passage portion 144 to a separate outlet portion 158. The branch portion 156 may include a first segment 159 having a first width, a second segment 160 having a second width, and a tapering segment 162 between the first segment 159 and the second segment 160. The second width may be smaller than the first width, and the tapering segment 162 may taper in width from the first width to the second width. The tapering segment 162 may be closer to the separate outlet portion 158 than the passage portion 144, in order to accelerate the flow of air as the flow of air is conveyed into the separate outlet portion 158. Although only one branch portion 156 is shown extending from a passage portion 144, each passage portion 144 may include one or more branch portions 156 (e.g., extending from opposite sides of the passage portion or on the same side to a respective outlet portion).

Collectively defining the cooling circuit 120 with the plates 102, 104, and 106 may provide many operational advantages, such as increased component cooling and or fuel distribution, lower manufacturing costs, and ease of assembly. Additionally, the stacked plate construction of the stacked cooling assembly 100 may advantageously lower manufacturing costs when compared to prior designs. For example, the various cavities defined in each of the plates 102, 104, 106, may be stamped onto the plates, which may advantageously reduce production cost and production time. While the drawings herein illustrate a particular use of the stacked cooling assembly 100 as a combustor cap, it should be understood that the cooling structures defined by the plates 102, 104, 106 may be used as part or all of a combustor liner (including a combustor liner aft frame).

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A stacked cooling assembly comprising: an inlet plate defining an inlet to a coolant circuit; an outlet plate defining an outlet of the coolant circuit; an intermediate plate disposed between the inlet plate and the outlet plate, the intermediate plate defining an intermediate cavity; and wherein a downstream surface of the inlet plate, an upstream surface of the outlet plate, and the intermediate cavity collectively define a connecting channel that fluidly couples the inlet to the outlet.

The stacked cooling assembly as in one or more of these clauses, wherein the inlet and the outlet are spaced apart from one another in one or more directions.

The stacked cooling assembly as in one or more of these clauses, wherein the intermediate cavity comprises an inlet portion fluidly coupled to and aligning with the inlet to the coolant circuit, an outlet portion fluidly coupled to and aligning with the outlet of the coolant circuit, and a passage portion extending between the inlet portion and the outlet portion.

The stacked cooling assembly as in one or more of these clauses, wherein a branch portion extends from the passage portion to a separate outlet portion.

The stacked cooling assembly as in one or more of these clauses, wherein the downstream surface of the inlet plate, the upstream surface of the outlet plate, and the passage portion of the intermediate cavity collectively define the connecting channel.

The stacked cooling assembly as in one or more of these clauses, wherein the passage portion includes a first segment having a first width, a second segment having a second width, and a tapering segment between the first segment and the second segment and wherein the tapering segment is closer to the outlet portion than the inlet portion.

The stacked cooling assembly as in one or more of these clauses, wherein the passage portion is tangentially connected to the outlet portion to produce a swilling flow of compressed air from the outlet portion.

The stacked cooling assembly as in one or more of these clauses, wherein the inlet plate defines a plurality of inlets, the outlet plate defines a plurality of outlets, and the intermediate plate defines a plurality of intermediate cavities fluidly coupling each respective inlet of the plurality of inlets to each respective outlet of the plurality of outlets.

The stacked cooling assembly as in one or more of these clauses, wherein the coolant circuit comprises the inlet, and wherein the outlet is one of a plurality of outlets each fluidly connected to the inlet via a respective connecting channel.

The stacked cooling assembly as in one or more of these clauses, further comprising a plurality of outer passages defined in the stacked cooling assembly and circumferentially spaced apart from one another, each outer passage extending axially through the inlet plate, the intermediate plate, and the outlet plate.

A combustor head end comprising: a stacked cooling assembly defining a cap of the combustor head end: and a fuel nozzle extending through the stacked cooling assembly:

wherein the stacked cooling assembly comprises: an inlet plate defining an inlet to a coolant circuit, the inlet fluidly coupled to a head end air plenum; an outlet plate defining an outlet of the coolant circuit; an intermediate plate disposed between the inlet plate and the outlet plate, the intermediate plate defining an intermediate cavity, and wherein a downstream surface of the inlet plate, an upstream surface of the outlet plate, and the intermediate cavity collectively define a connecting channel that fluidly couples the inlet to the outlet.

The combustor head end as in one or more of these clauses, further comprising a coolant tube extending to the inlet of the stacked cooling assembly.

The combustor head end as in one or more of these clauses, wherein the inlet and the outlet are spaced apart from one another in one or more directions.

The combustor head end as in one or more of these clauses, wherein the intermediate cavity comprises an inlet portion fluidly coupled to and aligning with the inlet to coolant circuit, an outlet portion fluidly coupled to and aligning with the outlet of coolant circuit, and a passage portion extending between the inlet portion and the outlet portion.

The combustor head end as in one or more of these clauses, wherein a branch portion extends from the passage portion to a separate outlet portion.

The combustor head end as in one or more of these clauses, wherein the downstream surface of the inter plate, the upstream surface of the outlet plate, and the passage portion of the intermediate cavity collectively define the connecting channel.

The combustor head end as in one or more of these clauses, wherein the passage portion includes a first segment having a first width, a second segment having a second width, and a tapering segment between the first segment and the second segment, and wherein the tapering segment is closer to the outlet portion than the inlet portion.

The combustor head end as in one or more of these clauses, wherein the passage portion is tangentially connected to the outlet portion to produce a swirling flow of compressed air from the outlet portion.

The combustor head end as in one or more of these clauses, wherein the inlet plate defines a plurality of inlets, the outlet plate defines a plurality of outlets, and the intermediate plate defines a plurality of intermediate cavities fluidly coupling each respective air inlet of the plurality of inlets to each respective outlet of the plurality of outlets.

The combustor head end as in one or more of these clauses, wherein the coolant circuit comprises the inlet, and wherein the outlet is one of a plurality of outlets each fluidly connected to the inlet via a respective connecting channel.

What is claimed is:

1. A stacked cooling assembly comprising:

an inlet plate defining an inlet to a coolant circuit, the inlet plate defining a forwardmost surface to the stacked cooling assembly;

an outlet plate defining a plurality of outlets of the coolant circuit, the outlet plate defining an aftmost surface to the stacked cooling assembly;

an intermediate plate having an upstream surface and a downstream surface, the intermediate plate disposed between the inlet plate and the outlet plate, the intermediate plate comprising an intermediate cavity defined entirely through the intermediate plate and extending between the upstream surface and the downstream surface, wherein the intermediate cavity comprises a plurality of passage portions; and wherein a downstream surface of the inlet plate closes an upstream side of the plurality of passage portions, and an upstream surface of the outlet plate closes a downstream side of the plurality of passage portions to define closed connecting channels that fluidly couple the inlet to each respective outlet of the plurality of outlets.

2. The stacked cooling assembly as in claim 1, wherein the inlet and the plurality of outlets are spaced apart from one another in one or more directions.

3. The stacked cooling assembly as in claim 1, wherein the intermediate cavity comprises an inlet portion fluidly coupled to and aligning with the inlet to the coolant circuit and a plurality of outlet portions each fluidly coupled to and aligning with a respective outlet of the plurality of outlets of the coolant circuit, and wherein each of the plurality of passage portions extends between the inlet portion and a respective outlet portion of the plurality of outlet portions.

4. The stacked cooling assembly as in claim 3, wherein each passage portion of the plurality of passage portions diverges away from neighboring passage portions of the plurality of passage portions between the inlet portion and the respective outlet portion of the plurality of outlet portions.

5. The stacked cooling assembly as in claim 3, wherein at least one passage portion of the plurality of passage portions includes a first segment having a first width, a second segment having a second width, and a tapering segment between the first segment and the second segment, and wherein the tapering segment is closer to the outlet portion than the inlet portion.

6. The stacked cooling assembly as in claim 3, wherein at least one passage portion of the plurality of passage portions is tangentially connected to a respective outlet portion of the plurality of outlet portions to produce a swirling flow of compressed air from the respective outlet portion.

7. The stacked cooling assembly as in claim 1, wherein the inlet plate defines a plurality of inlets, the outlet plate defines the plurality of outlets, and the intermediate plate defines a plurality of intermediate cavities fluidly coupling each respective inlet of the plurality of inlets to each respective outlet of the plurality of outlets.

8. The stacked cooling assembly as in claim 1, further comprising a plurality of outer passages defined in the stacked cooling assembly and circumferentially spaced apart from one another, each outer passage extending axially through the inlet plate, the intermediate plate, and the outlet plate.

9. The stacked cooling assembly as in claim 8, wherein the coolant circuit is one of a plurality of coolant circuits defined in the stacked cooling assembly, and wherein each coolant circuit of the plurality of coolant circuits is positioned circumferentially between two outer passages of the plurality of outer passages.

10. The stacked cooling assembly as in claim 9, further comprising a resonator circuit that extends coaxially with an axial centerline of the stacked cooling assembly, the resonator circuit being defined collectively by the inlet plate, the intermediate plate, and the outlet plate, and wherein the plurality of coolant circuits surround the resonator circuit.

11. The stacked cooling assembly as in claim 1, wherein at least one passage portion of the plurality of passage portions includes a tapering segment, and wherein a branch portion extends from the at least one passage portion of the plurality of passage portions upstream of the tapering segment.

12. The stacked cooling assembly as in claim 1, wherein the plurality of passage portions is defined entirely through the intermediate plate and extends between the upstream surface and the downstream surface.

13. A combustor head end comprising:

a stacked cooling assembly defining a cap of the combustor head end; and a fuel nozzle extending through the stacked cooling assembly;

wherein the stacked cooling assembly comprises:

an inlet plate defining an inlet to a coolant circuit, the inlet fluidly coupled to a head end air plenum, the inlet plate defining a forwardmost surface to the stacked cooling assembly;

an outlet plate defining a plurality of outlets of the coolant circuit, the outlet plate defining an aftmost surface to the stacked cooling assembly;

an intermediate plate having an upstream surface and a downstream surface, the intermediate plate disposed between the inlet plate and the outlet plate, the intermediate plate comprising an intermediate cavity defined entirely through the intermediate plate and extending between the inner surface and the outer surface, wherein the intermediate cavity comprises a plurality of passage portions; and wherein a downstream surface of the inlet plate closes an upstream side of the plurality of passage portions and an upstream surface of the outlet plate closes a downstream side of the plurality of passage portions to define closed connecting channels that fluidly couple the inlet to each respective outlet of the plurality of outlets.

14. The combustor head end as in claim 13, further comprising a coolant tube extending to the inlet of the stacked cooling assembly.

15. The combustor head end as in claim 13, wherein the inlet and the plurality of outlets are spaced apart from one another in one or more directions.

16. The combustor head end as in claim 13, wherein the intermediate cavity comprises an inlet portion fluidly coupled to and aligning with the inlet to the coolant circuit and a plurality of outlet portions each fluidly coupled to and aligning with a respective outlet of the plurality of outlets of the coolant circuit, and wherein each of the plurality of passage portions extends between the inlet portion and a respective outlet portion of the plurality of outlet portions.

17. The combustor head end as in claim 16, wherein the downstream surface of the inlet plate, the upstream surface of the outlet plate, and the plurality of passage portions of the intermediate cavity collectively define the connecting channels.

18. The combustor head end as in claim 16, wherein at least one passage portion of the plurality of passage portions includes a first segment having a first width, a second segment having a second width, and a tapering segment between the first segment and the second segment, and wherein the tapering segment is closer to the outlet portion than the inlet portion.

19. The combustor head end as in claim 16, wherein at least one passage portion of the plurality of passage portions is tangentially connected to a respective outlet portion of the plurality of outlet portions to produce a swirling flow of compressed air from the respective outlet portion.

* * * * *